US009169843B2

(12) United States Patent
Clothier et al.

(10) Patent No.: US 9,169,843 B2
(45) Date of Patent: Oct. 27, 2015

(54) TURBOMACHINE

(75) Inventors: Andrew Charlton Clothier, Malmesbury (GB); Roger Michael Dawe, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 501 days.

(21) Appl. No.: 13/594,392

(22) Filed: Aug. 24, 2012

(65) Prior Publication Data

US 2013/0052051 A1 Feb. 28, 2013

(30) Foreign Application Priority Data

Aug. 26, 2011 (GB) ..... 1114788.1

(51) Int. Cl.
*F04D 25/08* (2006.01)
*F04D 25/06* (2006.01)
*F04D 29/58* (2006.01)

(52) U.S. Cl.
CPC ..... *F04D 25/06* (2013.01); *F04D 29/584* (2013.01)

(58) Field of Classification Search
CPC ..... F04D 17/165; F04D 29/4213; F04D 29/4253; F04D 29/5806; F04D 29/5813; F04D 29/584; F04D 25/06
USPC ..... 417/371, 423.1–423.9, 423.11–423.14, 417/424.1, 424.2, 423.15; 361/697, 361/748–804; 310/52–59, 60 R, 61–63, 310/60 A, 64, 65, 216.025, 216.031
See application file for complete search history.

(56) References Cited

U.S. PATENT DOCUMENTS

| | | | | |
|---|---|---|---|---|
| 3,271,601 | A * | 9/1966 | Raver | 310/68 R |
| 3,407,995 | A * | 10/1968 | Kinsworthy | 415/94 |
| 4,255,684 | A * | 3/1981 | Mischler et al. | 310/216.031 |
| 4,513,812 | A * | 4/1985 | Papst et al. | 165/80.1 |
| 5,316,440 | A | 5/1994 | Kijima et al. | |
| 5,618,168 | A | 4/1997 | Moon | |
| 5,904,471 | A * | 5/1999 | Woollenweber et al. | 417/371 |
| 6,094,345 | A * | 7/2000 | Diemunsch | 361/695 |
| 6,175,171 | B1 * | 1/2001 | Rupp et al. | 310/52 |
| 6,413,039 | B1 | 7/2002 | Morris et al. | |
| 6,439,845 | B1 | 8/2002 | Veres | |
| 6,447,631 | B1 | 9/2002 | Schahl et al. | |
| 2005/0158172 | A1 | 7/2005 | Snyder et al. | |
| 2006/0202572 | A1 * | 9/2006 | Tungl et al. | 310/58 |
| 2010/0254826 | A1 * | 10/2010 | Streng et al. | 417/44.1 |

FOREIGN PATENT DOCUMENTS

| | | |
|---|---|---|
| DE | 3137981 | 4/1983 |
| DE | 4038775 | 6/1992 |

(Continued)

OTHER PUBLICATIONS

Search Report dated Dec. 15, 2011, directed to counterpart GB Application No. 1114788.1; 1 page.

*Primary Examiner* — Peter J Bertheaud
*Assistant Examiner* — Dnyanesh Kasture
(74) *Attorney, Agent, or Firm* — Morrison & Foerster LLP

(57) ABSTRACT

A turbomachine that includes a housing and a circuit assembly. The housing includes an inlet for admitting a working airflow and a flange that extends from the inlet. The circuit assembly includes a circuit board and an electrical component having a heat sink. The circuit assembly is located within the housing such that the flange extends beyond the circuit board and the heat sink extends beyond the flange.

7 Claims, 3 Drawing Sheets

(56) References Cited

FOREIGN PATENT DOCUMENTS

| | | |
|---|---|---|
| FR | 2827345 | 1/2003 |
| GB | 2467964 | 8/2010 |
| GB | 2467967 | 8/2010 |
| GB | 2467969 | 8/2010 |
| JP | 61-65865 | 5/1986 |
| JP | 2006-109575 | 4/2006 |
| JP | 2007-202253 | 8/2007 |
| JP | 2007-300698 | 11/2007 |
| JP | 2008-17656 | 1/2008 |
| WO | WO-2005/054694 | 6/2005 |
| WO | WO-2011/033800 | 3/2011 |

* cited by examiner

TURBOMACHINE

REFERENCE TO RELATED APPLICATIONS

This application claims the priority of United Kingdom Application No. 1114788.1, filed Aug. 26, 2011, the entire contents of which are incorporated herein by reference.

FIELD OF THE INVENTION

The present invention relates to a turbomachine.

BACKGROUND OF THE INVENTION

The circuit assembly of a turbomachine may be located in a position that is exposed to the working airflow. This then has the benefit that components of the circuit assembly are cooled by the airflow. However, a difficulty with this arrangement is that any liquid inadvertently carried by the airflow may short and permanently damage the circuit assembly.

SUMMARY OF THE INVENTION

In a first aspect, the present invention provides a turbomachine comprising a housing and a circuit assembly, wherein the housing comprises an inlet for admitting a working airflow and a flange that extends from the inlet, the circuit assembly comprises a circuit board and an electrical component having a heat sink, and the circuit assembly is located within the housing such that the flange extends beyond the circuit board and the heat sink extends beyond the flange.

The flange acts to screen the circuit board from the working airflow. Consequently, should the airflow inadvertently carry any liquid, the risk of liquid finding its way onto the circuit board is reduced. The heat sink extends beyond the flange and is therefore exposed to the working airflow. Consequently, although the circuit board is better protected, cooling of the component by the working airflow continues to take place.

The circuit board may surround the flange and comprise an aperture through which the flange extends. This then simplifies the manufacture of the turbomachine. In particular, where the circuit assembly comprises a large number of electrical components, a single circuit board may be employed for the circuit assembly. Additionally, the circuit assembly is able to make better use of the available space and thus an overall more compact turbomachine may be achieved.

The turbomachine may comprise a rotor assembly located within the housing. The rotor assembly may comprise a shaft to which a rotor core and an impeller are mounted. Moreover, the rotor core may be proximal to the inlet and the impeller may be distal to the inlet. The impeller is therefore spaced from the inlet. As a result, the working airflow moves through the housing in a generally axial direction from the inlet to the impeller. Since the flange extends axially beyond the circuit board and the airflow moves generally axially through the housing, a region of dead space is effectively created at the circuit board.

The turbomachine may comprise an electrical machine and the component may be a power switch for controlling power to or from the electrical machine. By providing a heat sink that is exposed to the working airflow, the power switch may operate at switching frequencies and/or carry currents that would otherwise damage the power switch.

The turbomachine may comprise a stator assembly, and the inlet may overlie the stator assembly such that the stator assembly is visible through the inlet. As a result, the stator assembly is exposed to the working airflow, which then acts to cool the stator assembly. The stator assembly may comprise a pair of opposing stator cores, and the inlet may be elongated. By employing an elongated inlet, the working airflow may be better directed at the stator assembly.

The heat sink may extend axially alongside the stator assembly. This then enables a more compact arrangement to be achieved whilst ensuring that working airflow cools both the heat sink and the stator assembly.

In a second aspect, the present invention provides a turbomachine comprising a housing, an impeller and a motor, wherein the impeller and the motor are located within the housing, the impeller is driven by the motor, the motor comprises a circuit assembly, the circuit assembly comprises a circuit board and one or more power switches for controlling electrical power to the motor, each power switch comprises a heat sink, the housing comprises an inlet and a flange that extends from the inlet, the impeller draws an airflow into the housing via the inlet, and the circuit assembly is located within the housing such that the flange extends beyond the circuit board and the heat sinks extends beyond the flange.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
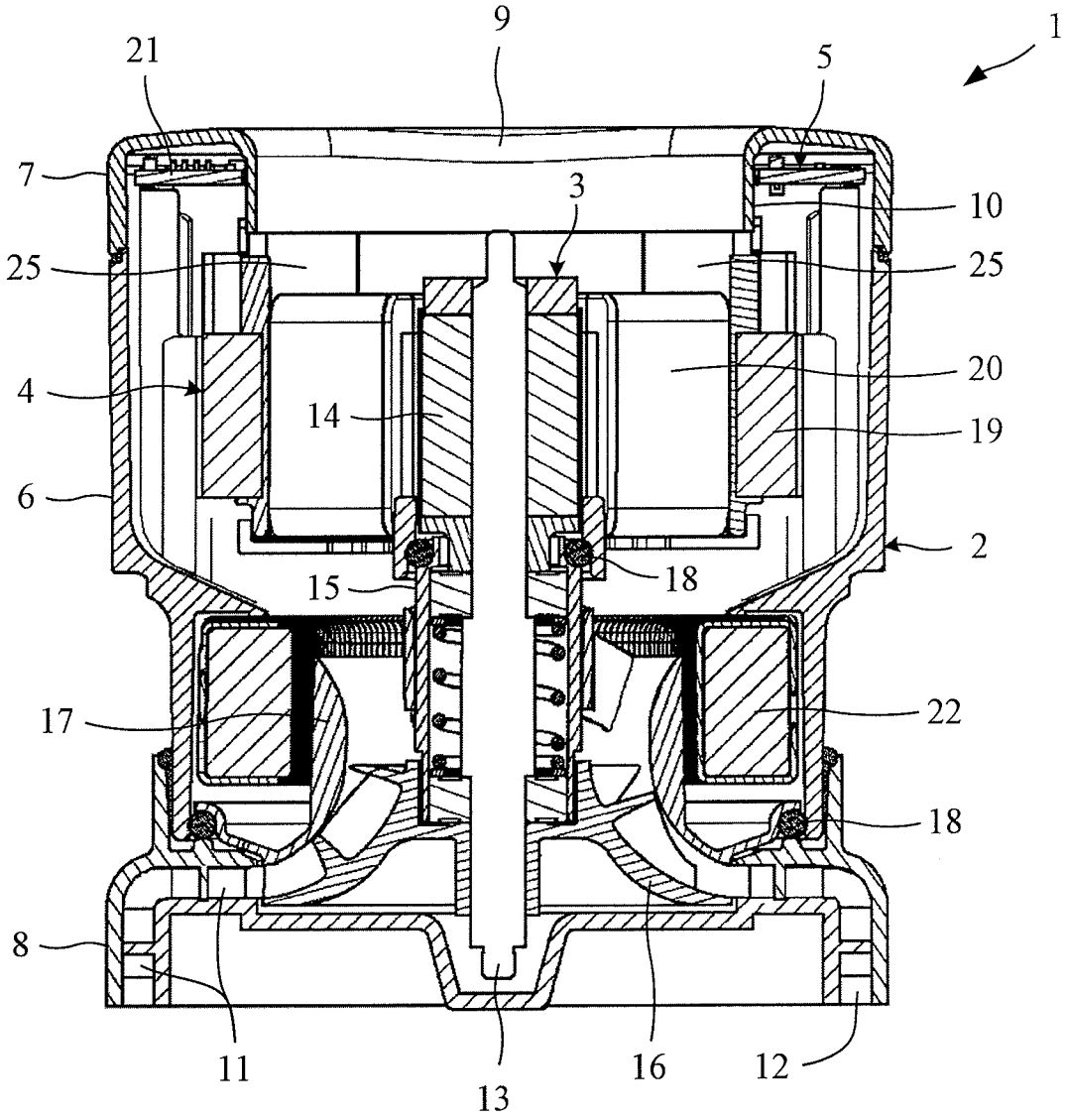
FIG. 1 is a sectional view of a turbomachine in accordance with the present invention.
Figure 2:
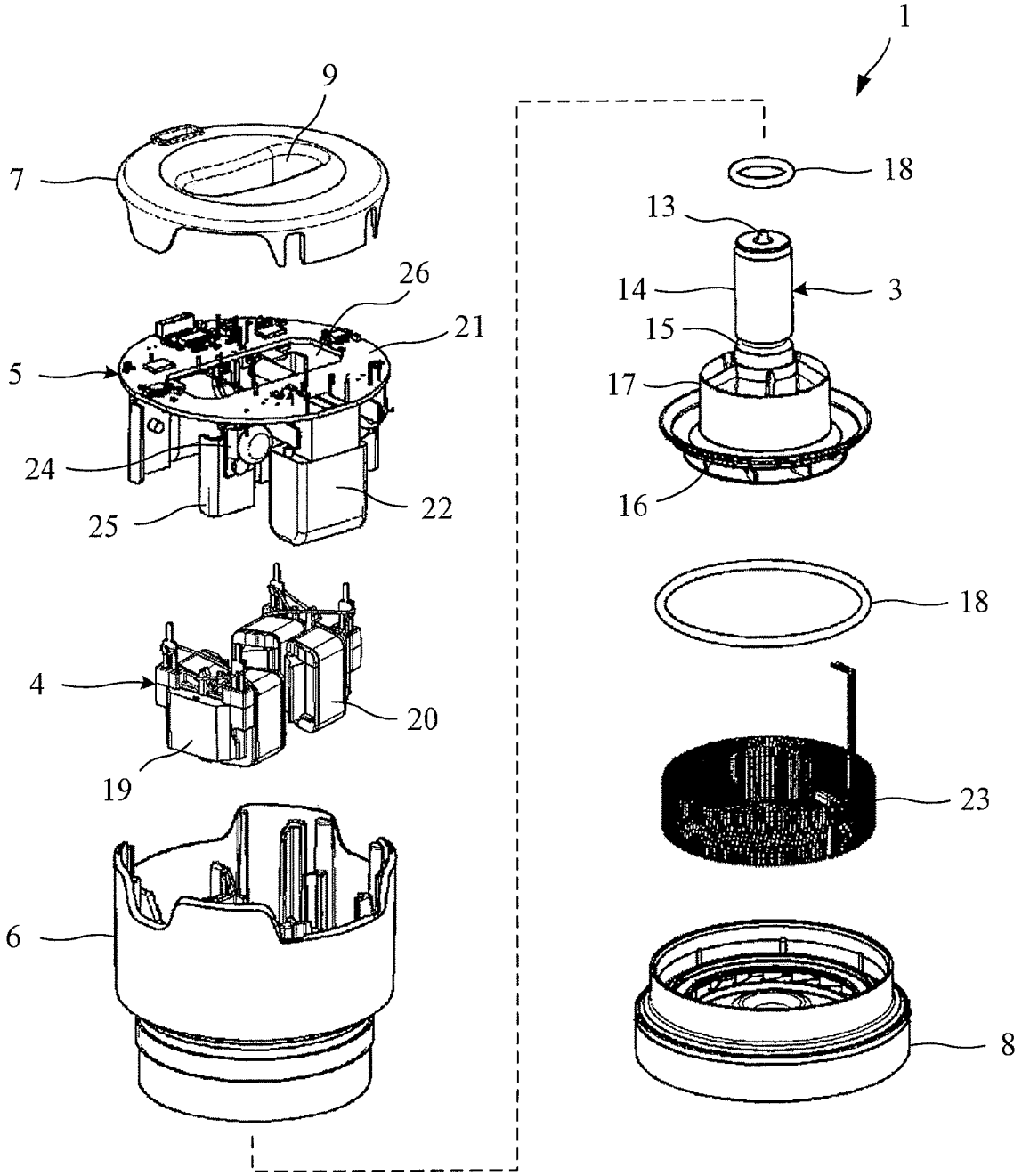
FIG. 2 is an exploded view of the turbomachine.
Figure 3:
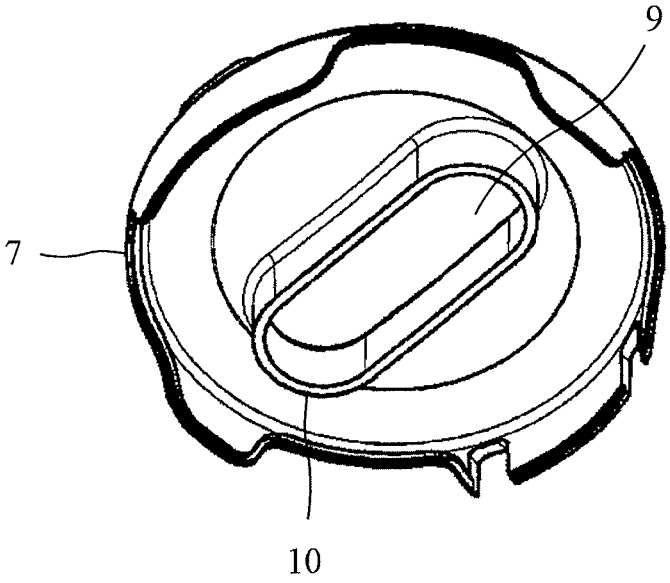
FIG. 3 is an underside view of the upper cover of the turbomachine.

The turbomachine 1 of FIGS. 1 and 2 comprises a housing 2, a rotor assembly 3, a stator assembly 4, and a circuit assembly 5.

The housing 2 comprises a main body 6, an upper cover 7, and a lower cover 8. The main body 6 comprises an internal frame that supports the rotor assembly 3, the stator assembly 4, and the circuit assembly 5. The upper cover 7 is secured to a first end of the main body 6 and comprises an inlet 9 through which a working airflow is admitted, and an annular flange 10 that extends inwardly from the inlet 8. The lower cover 8 is secured to a second end of the main body 6 and comprises diffuser vanes 11 and an outlet 12 through which the working fluid is discharged.

The rotor assembly 3 comprises a shaft 13, a rotor core 14, a bearing assembly 15, an impeller 16 and a shroud 17. The rotor core 14, the bearing assembly 15 and the impeller 16 are each mounted to the shaft 13. The shroud 17 is mounted to the bearing assembly 15 so as to cover the impeller 16. The rotor assembly 3 is mounted to the main body 6 of the housing 2 at the bearing assembly 15 and at the shroud 17. More particularly, the rotor assembly 3 is soft mounted at each location by an o-ring 18. The rotor assembly 3 is oriented within the housing 2 such that the rotor core 14 is proximal to the inlet 9 and the impeller 16 is distal to the inlet 10.

The stator assembly 4 comprises a pair of stator cores 19 arranged on opposite sides of the rotor core 14. Conductive wires 20 are wound about the stator cores 19 and are coupled together to form a phase winding. The phase winding is then electrically coupled to the circuit assembly 5. The inlet 9 overlies the stator assembly 4 such that the stator assembly 4 is visible through the inlet 9. As explained below, this then ensures that the working airflow, as it moves from the inlet 9 to the impeller 16, acts to cool the stator assembly 4.

The circuit assembly 5 comprises a circuit board 21 and a plurality of electrical components 22. Among the electrical components 21 are a toroidal inductor 23 and four power switches 24 (e.g. BJT, MOSFET, IGBT). The inductor 23 surrounds the rotor assembly 3 and is located between the stator assembly 4 and the impeller 16. The winding of the inductor 23 then extends axially past the stator assembly 4 and is electrically coupled to the circuit board 21. The four power switches 24 control the delivery of electrical power to the phase winding of the stator assembly 4. More particularly, the power switches 24 are arranged as an H-bridge that is coupled to the phase winding. Each of the power switches 24 comprises a heat sink 25.

The circuit assembly 5 is located adjacent the upper cover 7. Moreover, the circuit board 21 surrounds the flange 10 and includes an aperture 26 through which the flange 10 extends. The flange 10 thus extends axially beyond the circuit board 21. The heat sink 25 of each power switch 24 extends axially beyond the flange 10. More particularly, each heat sink 25 extends axially along a side of the stator assembly 4.

During operation of the turbomachine 1, the impeller 16 draws a working airflow into the housing 2 via the inlet 9. Owing to the location of the impeller 16 within the housing 2, the airflow moves generally axially through the housing 2 from the inlet 9 to the impeller 16. As the airflow moves through the housing 2, the airflow passes over the stator assembly 4 and the heat sinks 25. The airflow thus acts to cool the stator assembly 4 and the power switches 24.

In passing over the stator assembly 4, the airflow acts to cool the stator assembly 4. As a result, copper losses are reduced and thus a more efficient turbomachine 1 is achieved. The stator assembly 4 comprises a pair of opposing stator cores 19, each of which is generally c-shaped. Accordingly, the overall shape of the stator assembly 4 is elongated. The inlet 9 is therefore similarly elongated such that the airflow is better directed to the stator assembly 4.

In passing over the heat sinks 25, the airflow acts to cool the power switches 24. The power switches 24 are therefore able operate at switching frequencies and/or carry currents that would otherwise damage the power switches 24 due to the excessive heat associated with the power losses. The heat sinks 25 extend axially along the sides of the stator assembly 4. This then provides a more compact arrangement whilst ensuring that working airflow cools both the heat sinks 25 and the stator assembly 4.

The flange 10 acts to screen the circuit board 21 from the working airflow. Since the flange 10 extends axially beyond the circuit board 21 and the airflow moves generally axially through the housing 2, a region of dead space is effectively created at the surface of the circuit board 21. Accordingly, should any liquid be carried inadvertently by the working airflow, there is less risk of the liquid finding its way onto the circuit board 21. Although the circuit board 21 is not directly exposed to the working airflow, the heat sinks 25 are. Consequently, the power switches 24 continue to be cooled in spite of the fact that the circuit board 21 is better protected.

The circuit assembly 5 comprises a large number of electrical components 22 mounted on the circuit board 21. By having a circuit board 21 that surrounds the flange 10, good use is made of the available space and thus a more compact turbomachine 1 may be realised. Additionally, in surrounding the flange 10, a single circuit board 21 may be employed for the circuit assembly 5. This then simplifies the manufacture and assembly of the turbomachine 1. In contrast, if the circuit assembly 5 were to comprise two smaller circuit boards located on opposite sides of the flange 10, electrical connections would then be required between the two boards.

The shaft 13 and the rotor core 14 of the rotor assembly 3, along with the stator assembly 4 and the circuit assembly 5, may be collectively regarded as a motor that drives the impeller 16. Alternatively, these components may collectively take the form of a generator that is driven by the impeller 16. Accordingly, in a more general sense, the turbomachine 1 may be said to comprise an electrical machine that drives or is driven by an impeller 16. The circuit assembly 5 then comprises at least one power switch 24 for controlling electrical power to or from the electrical machine. In the particular embodiment described above, the electrical machine takes the form of a brushless DC motor. Alternatively, however, the electrical machine may be brushed and/or driven by an AC voltage.

The invention claimed is:

1. A turbomachine comprising a housing, a circuit assembly and a stator assembly, wherein:

the housing comprises an inlet for admitting a working airflow and a flange that extends from the inlet, the inlet overlying the stator assembly such that the stator assembly is visible through the inlet, the circuit assembly comprises a circuit board and an electrical component having a heat sink, and the circuit assembly is located within the housing such that the flange extends beyond the circuit board and the heat sink extends beyond the flange, wherein:

the circuit board lies along a plane orthogonal to an axis of rotation of a rotor, and the plane is located at a first elevation on the axis of rotation of the rotor;

the flange extends axially through the circuit board at least from the first elevation down to a second elevation on the axis;

the electrical component and the heat sink extend axially from the first elevation down to a third elevation on the axis that is lower than the second elevation on the axis;

the stator assembly extends from a fourth elevation along the axis to a fifth elevation on the axis; and a portion of the axis between the fourth elevation and the fifth elevation overlaps with a portion of the axis between the first elevation and the third elevation.

2. The turbomachine as claimed in claim 1, wherein the flange is annular and the circuit board surrounds the flange and comprises an aperture through which the flange extends.

3. The turbomachine as claimed in claim 1, wherein the turbomachine comprises a rotor assembly located within the housing, the rotor assembly comprises a shaft to which a rotor core and an impeller are mounted, the rotor core is proximal to the inlet, and the impeller is distal to the inlet.

4. The turbomachine as claimed in claim 1, wherein the turbomachine comprises an electrical machine and the component is a power switch for controlling power to or from the electrical machine.

5. The turbomachine as claimed in claim 1, wherein the stator assembly comprises a pair of opposing stator cores, and the inlet is elongated.

6. A turbomachine comprising a housing, an impeller and a motor, wherein the impeller and the motor are located within the housing, the impeller is driven by the motor, the motor comprises a circuit assembly, the circuit assembly comprises a circuit board and one or more power switches for controlling the supply of electrical power to the motor, each power switch comprises a heat sink, the housing comprises an inlet and a flange that extends from the inlet, the impeller draws an airflow in the housing via the inlet, and the circuit assembly is located within the housing such that the flange extends beyond the circuit board and the heat sink extends beyond the flange, wherein:

the circuit board lies along a plane orthogonal to an axis of rotation of a rotor, and the plane is located at a first elevation on the axis of rotation of the rotor;

the flange extends axially through the circuit board at least from the first elevation down to a second elevation on the axis;

the electrical component and the heat sink extend axially from the first elevation down to a third elevation on the axis that is lower than the second elevation on the axis;

the stator assembly extends from a fourth elevation along the axis to a fifth elevation on the axis; and a portion of the axis between the fourth elevation and the fifth elevation overlaps with a portion of the axis between the first elevation and the third elevation.

7. The turbomachine as claimed in claim 6, wherein the motor comprises a rotor assembly, the rotor assembly comprises a shaft to which a rotor core and the impeller are mounted, the rotor core is proximal to the inlet, and the impeller is distal to the inlet.

* * * * *